United States Patent [19]

Fischer

[11] 4,340,141

[45] Jul. 20, 1982

[54] UNIT DOSE DRUG CONTROL PACKAGE

[75] Inventor: Arthur Fischer, Stamford, Conn.

[73] Assignee: E. I. Du Pont de Nemours and Company, Wilmington, Del.

[21] Appl. No.: 237,458

[22] Filed: Feb. 23, 1981

[51] Int. Cl.[3] ..... B65D 21/02; B65D 75/36; B65D 83/04

[52] U.S. Cl. ..... 206/531; 206/534; 206/528; 229/72

[58] Field of Search ..... 206/531, 532, 538, 539, 206/499, 422, 534, 528; 229/72

[56] References Cited

U.S. PATENT DOCUMENTS

| | | | |
|---|---|---|---|
| 3,054,503 | 9/1962 | Hartman et al. | 206/531 |
| 3,283,885 | 11/1966 | Grunewald et al. | 206/532 |
| 3,503,493 | 3/1970 | Nagy | 206/534 |

FOREIGN PATENT DOCUMENTS

| | | | |
|---|---|---|---|
| 859539 | 12/1970 | Canada | 206/534 |
| 2917108 | 11/1980 | Fed. Rep. of Germany | 206/534 |
| 537319 | 7/1973 | Switzerland | 206/531 |

*Primary Examiner*—William Price
*Assistant Examiner*—Brenda Ehrhardt

[57] ABSTRACT

A unit dose drug control package is provided for the control and accountability of drugs where there is such a need such as narcotics. The package is foldable into a compact, interlocking package, has a plurality of individually removable and identifiable unit drug dose packages, and has a pocket for a product brochure and for returning a unit drug dose package once it has been separated from the package.

2 Claims, 4 Drawing Figures

UNIT DOSE DRUG CONTROL PACKAGE

BACKGROUND OF THE INVENTION

1. Field of Invention

This invention relates to unit dose packages and more particularly to such packages for the control and accountability of drugs where there is a need for control and accountability such as narcotics.

2. Prior Art

The art is replete with so-called blister packages for the packaging and protection of unit articles such as capsules and tablets in the pharmaceutical field, and houseware and hardware articles. Narcotic control packages in hospitals for example are currently rolled-up strips of individually blister packaged tablets which can be torn from the strip as needed. Each strip of about 25 tablets is contained in a product labelled box. Such a package is susceptible to theft since the strip can be removed from the box, tablets removed from the end of the strip, and the strip reinserted in the box. Thus, there is a need for a compact package for narcotics which enables an individual upon quick inspection to see if any tablet is missing. Also, in addition to drug control, the package should assure the individual user that product quality is present for each drug dose.

SUMMARY OF THE INVENTION

According to the present invention there is provided a drug control package laminate which comprises, in combination:

(1) a pair of semi-rigid backing sheets, each sheet having a plurality of aligned holes therein at one end, said holes in said backing sheets superimposed, and said sheets secured at the edges at the end opposite the holes to form a pocket therebetween;

(2) a continuous sheet of flexible, clear film having a plurality of hollow blisters therein with a planar section between the blisters, said blisters superimposed with the holes in said backing sheets and extended through the holes in one of said backing sheets, the planar section secured to the underside of the first backing sheet;

(3) a continuous sheet of rupturable material covering the blister hollows so as to close the blisters, said rupturable sheet placed between and secured to the underside of said blister sheet and to the underside of said second backing sheet;

(4) a unit drug dose in each closed blister; said laminate being scored along predetermined lines:

(a) to form a plurality of individually removable unit dose packages corresponding to each of the closed blisters, each unit dose package being identified with product name and a sequential dose number; and (b) to be foldable transversely into a compact package wherein the blisters interlock to form a single layer.

DETAILED DESCRIPTION OF THE INVENTION

Figure 1:
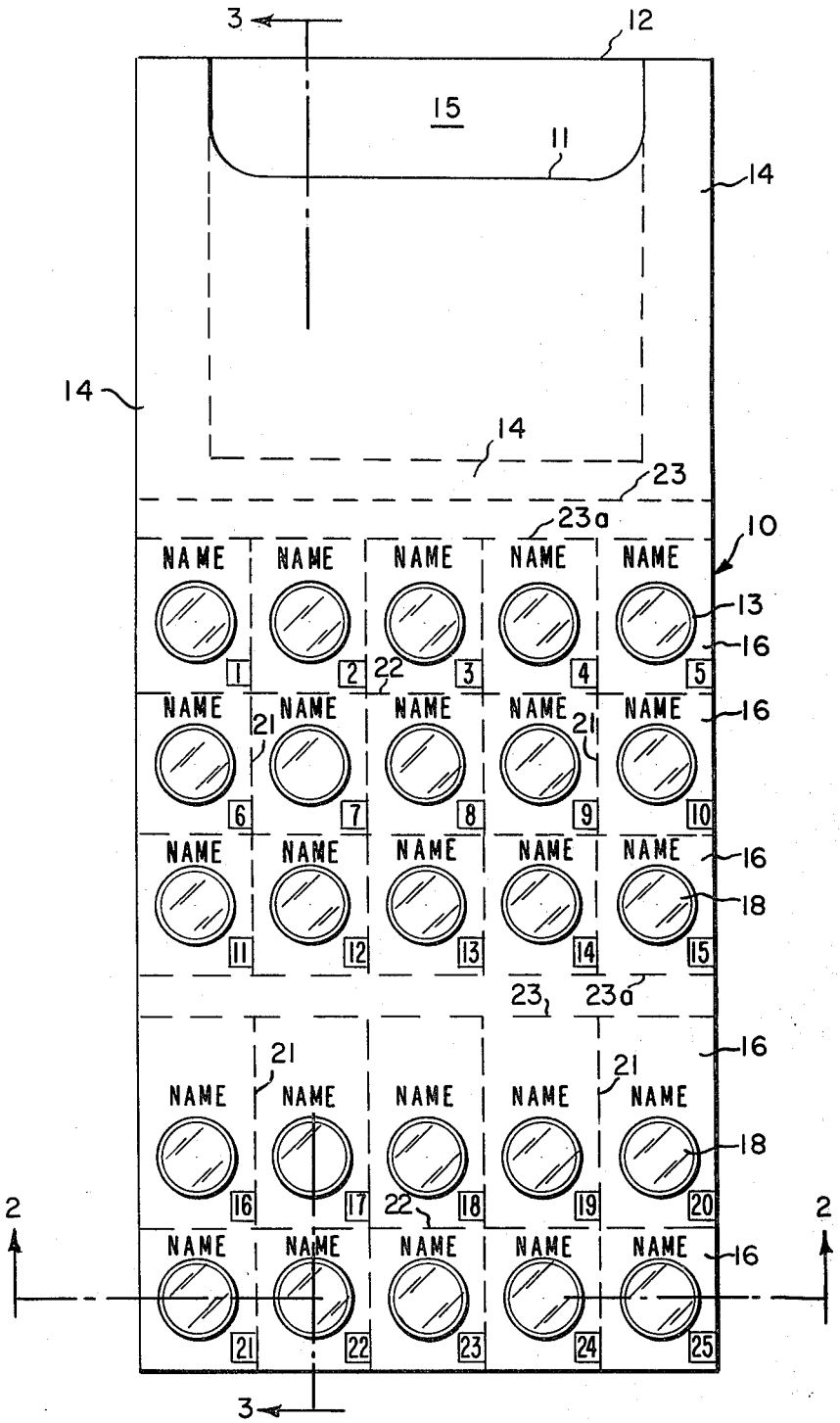
FIG. 1 is a top plan view of a unit dose package of the present invention.
Figure 2:
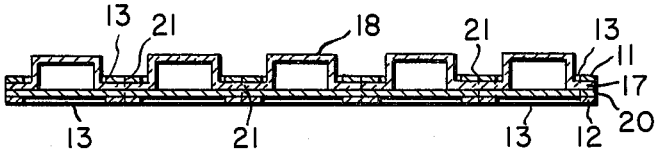
FIG. 2 is an enlarged cross-sectional view of the unit dose package taken along line 2—2 of FIG. 1.
Figure 3:
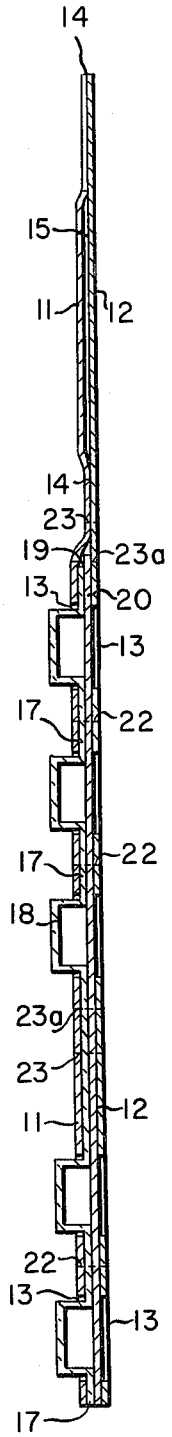
FIG. 3 is an enlarged cross-sectional view of the unit dose package taken along line 3—3 of FIG. 1.

With reference to the drawings, a unit dose package of the invention is generally designated 10. Package 10 is a laminate composed of a pair of rectangular, semi-rigid backing sheets 11 and 12 each having aligned holes 13 therein at one end which are superimposed with one another. The backing sheets can be made from any material capable of giving some rigidity to package 10. Illustrative of such material are stiff paper, paperboard, cardboard, polymer coated paper and cardboard, plastics and similar shape retaining materials. Preferred backing sheets are made from 8 mil bleached sulfate paper having a vinyl heat seal coating on the inside surfaces for securing the edges 14 at the end opposite holes 13 to form a pocket 15 therebetween. Pocket 15 is used for the initial insertion of a product information bulletin and during use of the package, such as in a hospital, to hold an individual unit-dose package 16 which has been removed and refused by a patient. Each unit-dose package 16 is labelled with the product name and a sequential dose number. In the package shown in the drawings, there are 25 unit doses which are used in reverse order so as to show the number of unit doses remaining.

A rectangular continuous blister sheet of a flexible, clear plastic film 17 having a plurality of hollow blisters 18 therein corresponding to the number of holes 13 in backing sheets 11 and 12 is located under sheet 11. The blisters extend through the holes 13 in backing sheet 11 and the open ends of the blisters 18 are over the superimposed holes 13 in backing sheet 12. The planar section between the blisters is secured to the inside surface of backing sheet 11 by means of the heat seal coating on the inside surface of backing sheet 11. Blister sheet 17 ends at point 19 just before pocket 15 begins. The blister sheet can be made from any clear, flexible film which cannot be easily ruptured such as a vinyl thermoplastic film about 10 mils in thickness which as a heat sealable layer of polyethylene on the surface containing the open ends of the blisters.

A continuous sheet of rupturable material 20 is coextensive with blister sheet 17 and covers the blister hollows so as to close the blisters and the medicaments or drugs contained in the closed blisters. The rupturable material is preferably aluminum foil 1 mil in thickness having a vinyl heat seal coating on both surfaces. Rupturable sheet 20 is secured to the underside of blister sheet 17 and the underside or inside surface of backing sheet 12.

Package laminate 10 is scored and perforated along a plurality of predetermined lines 21 and 22. These score lines are preferably perpendicular to one another and form a plurality of individually removable unit dose packages 16, each unit dose package corresponding to one of the closed blisters 18 with a unit drug dose contained therein. As shown in the drawings, there are five rows of five unit dose packages 16; however, there may be as many rows and number of unit dose packages as may be required or convenient. Each unit dose package 16 is labelled with the product name and is sequentially numbered in reverse order, i.e., the first unit package used has the highest number.

As shown in the drawings, unit dose package 25 is the first individual dose removed from package 10 by tearing along score lines 21 and 22. Each unit dose package 16 may also be labelled, if desired, with drug lot number and expiration date, preferably on the reverse side shown in FIG. 1.

Figure 4:
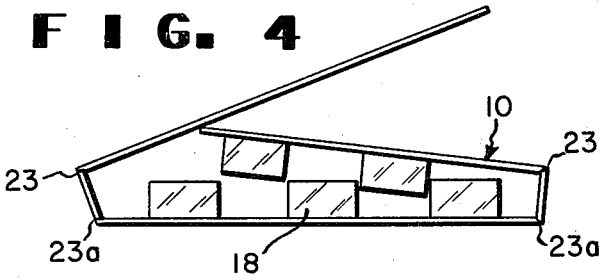
FIG. 4 is a side elevational view of the unit dose package partially folded showing the compact interlocking relationship of individual blisters.

Package laminate 10 also has score and perforation lines 23 and 23*a* which enables the package 10 to be folded transversely into a compact package. The distance between score lines 23 and 23*a* is essentially the same as the height of blisters 18. The spacing of rows of blisters 18 and the unit dose packages 16 is such that when package 10 is folded along transverse score lines 23 and 23*a*, blisters 18 nestle or interlock so as to form a single layer as more fully shown in FIG. 4.

In use, package 10 with individually identified and removable unit dose packages 16 is particularly suitable for the packaging and control of narcotics or other drugs where there is a need for accountability. For example, when a new package 10 is opened, it is immediately shown that there are 25 unit doses contained in the package. When the first dose is removed for a patient, i.e., unit dose number 25, immediate inspection shows 24 doses remaining. In the event the patient refuses the drug dose, unit drug dose 25 can be inserted in pocket 15 of package 10 and used later since inspection shows that the unit dose is the correct product and its sequential number shows it is the next dose to be used.

What is claimed is:

1. A drug control package laminate comprising, in combination:

(1) a pair of semi-rigid backing sheets, each sheet having a plurality of aligned holes therein at one end, said holes in said backing sheets superimposed, and said sheets secured at the edges at the end opposite the holes to form a pocket therebetween;

(2) a continuous sheet of flexible, clear film having a plurality of hollow blisters therein with a planar section between the blisters, said blisters superimposed with the holes in said backing sheets and extended through the holes in one of said backing sheets, the planar section secured to the underside of the first backing sheet;

(3) a continuous sheet of rupturable material covering the blister hollows so as to close the blisters, said rupturable sheet placed between and secured to the underside of said blister sheet and to the underside of said second backing sheet;

(4) a unit drug dose in each closed blister; said laminate being scored along predetermined lines:

(a) to form a plurality of individually removable unit dose packages corresponding to each of the closed blisters, each unit dose package being identified with product name and a sequential dose number; and (b) to be foldable transversely into a compact package wherein the blisters interlock to form a single layer.

2. The drug control package of claim 1 wherein the backing sheets are paper having a heat sealable coating on one surface, the rupturable sheet is aluminum foil having a heat sealable coating on one surface and the blister sheet is a vinyl plastic.

* * * * *